United States Patent [19]

Bassett

[11] 3,982,712

[45] Sept. 28, 1976

[54] COIL DISPENSER

[76] Inventor: Eugene E. Bassett, Box 298-R.F.D. No. 2, Lisbon, Conn. 06351

[22] Filed: Nov. 28, 1975

[21] Appl. No.: 632,289

[52] U.S. Cl. ..... 242/129; 242/137.1; 206/395; 206/397

[51] Int. Cl.[2] ..... B65H 49/18; B65H 49/00; B65D 85/66

[58] Field of Search ..... 242/129, 129.53, 129.62, 242/137.1, 129.72, 159, 171; 206/389, 392, 395–397

[56] References Cited

UNITED STATES PATENTS

| | | | |
|---|---|---|---|
| 469,941 | 3/1892 | Hendryx | 242/171 |
| 1,936,227 | 11/1933 | Cook | 242/137.1 |
| 2,716,008 | 8/1955 | Taylor, Jr. | 242/159 |
| 3,172,617 | 3/1965 | Johnson | 242/129.5 |
| 3,329,259 | 7/1967 | Mayer | 206/395 |

*Primary Examiner*—Leonard D. Christian

[57] ABSTRACT

An assembly for packaging a coil of wire or other strand material. At least one dispensing strip embraces the outer surface of the coil generally diametrically and across its traversed portion and includes a pair of pyramid-shaped members which project into the central core of the coil from opposite directions. Wire from the core of the coil is drawn through a hollow feed tube which extends radially through the windings of the coil. For support and protection of the coil, a container is provided and includes a window positioned for withdrawal of the wire from the coil. By reason of its construction or, alternatively, by its composition of appropriate transparent material, the container enables an inspection of its contents.

15 Claims, 16 Drawing Figures

COIL DISPENSER

BACKGROUND OF THE INVENTION

This invention relates generally to improved techniques for packaging and dispensing strand material and the like.

In the following specification and claims, the term "strand material" is employed in a general sense to apply to all kinds of elongated material including wire, tape, textile materials, or otherwise, and the term "coil" is intended to mean the product of a winding machine, whatever its form.

In the past, a large variety of spools, reels, rolls, and other containers have been utilized for packaging various forms of strand material, whether textile, tape, wire, or of some other general form. In some instances, such containers served as an outer protection for the goods contained. In other instances, such containers served as an attractive advertising display for the goods. In some other instances, such containers also served to dispense the strand material from the coil. However, in most cases, the coil was exposed to pilferage and damage to its outer surfaces.

Those known containers which were constructed to dispense the strand material were often of a complex design employing an excessive amount of material and requiring excessive labor or expensive machinery for their production. With many such containers, it was necessary for the entire coil to rotate in order to dispense the strand material. Such rotation created friction which was harmful to the stand material. In addition, the drag thus produced prevented easy and rapid removal of the strand material from the coil. Another undesirable result of such known designs was the fact that the strand material became twisted as it was withdrawn from the package.

To avoid this resultant twist, it has been found desirable to utilize coils having a universal wind. The term "universal wind" refers to a coil wound in such a manner that the strand material forms two complete turns, or multiples thereof, for each traverse across the face of the coil being wound. By reason of the universal wind, the strand material can be readily withdrawn from the coil in a twistless fashion at relatively high rates of payout. However, even in these instances, there were drawbacks in that such dispensing packages were of complex and costly design and not readily applicable to mass production techniques.

SUMMARY OF THE INVENTION

The present invention serves as in improvement over these known constructions. To this end, it is directed to an assembly for packaging a coil of strand material in which at least one dispensing strip is positioned to embrace the outer surface of the coil generally diametrically and across its traversed portion. In keeping with the invention, it is preferred that the coil being packaged is wound with a universal wind. The dispensing strip is folded at spaced locations into a pair of pyramid-shaped members which project into the central core of the coil from opposite directions. Strand material from the inner surface or core of the coil is drawn through a hollow feed tube which extends radially through the windings of the coil. For support and protection of the coil, a container may be provided with an opening positioned for withdrawal of the strand material from the coil. Additionally, it may be desirable for the container to be slotted to enable a user to view the amount of wire remaining on the coil. By drawing the strand material from the inside of the package, twist in the strand material so withdrawn is eliminated.

Also eliminated is the necessity for rotating the entire coil, as was necessary when the strand material was withdrawn from the outside of the coil. With the coil thus remaining immobile in the package, there are no moving parts, and friction and resulting abrasion to the strand material is held to a minimum.

Furthermore, there are no sharp edges to damage the strand material or to cause the strand material to snag thereby assuring free flow of the strand material as it is withdrawn from the coil.

The invention, by its design, utilizes a minimum amount of material, and can be easily produced by means of automated machinery.

In one embodiment of the invention, the coil, together with its dispensing strip and feed tube can be protectively placed in a container provided with an opening positioned for withdrawal of the wire from the coil. The container may be a corrugated fiberboard carton or any other appropriate stiff material so perforated as to define the openings. Because of this design, pilferage of strand material from a coil can be readily detected in the event the perforations have been tampered with. In a similar fashion, the carton can be perforated to define a removable tab. When removed, the tab exposes a slot to enable a user to view the amount of wire remaining on the coil.

In another embodiment of the invention, a pair of dispensing strips are employed, each folded intermediate its ends into a pyramid shape. One strip is positioned on one side of the coil and the other strip is positioned on the other side of the coil such that their respective pyramids project into the central core of the coil from opposite directions. Such a construction is beneficial from a manufacturing standpoint, but in all other respects it achieves the same desirable results as the first embodiment described.

In yet another embodiment of the invention, it is proposed to enclose the assembbly of the coil, dispensing strip, and feed tube within a bag or wrapper of plastic material such a vinyl, polyethylene, or the like. The plastic wrapper is preferably heat shrunk to closely conform to the outer contour of the assembly being enclosed. The plastic wrapper maintains the assembly intact and protects it during handling while assuring its wateright integrity. Further, the use of transparent plastic material permits an inspection of the condition of the contents and the amount of strand material remaining on the coil. In another variation of this embodiment, two or more such assemblies may be placed in a single plastic wrapper. In this manner, a single container could provide, for example, strand material in a multiple of colors or textures, or the like. Similarly, two or more individually wrapped assemblies may be contained in a single fiberboard container.

It is to be understood that both the foregoing general description and the following detailed description are exemplary and explanatory but are not restrictive of the invention.

The accompanying drawings, which are incorporated in, and constitute a part of this invention, illustrate a preferred embodiment of the invention, and together with the description, serve to explain the principles of the invention.

OF THE DRAWINGS

Figure 1:
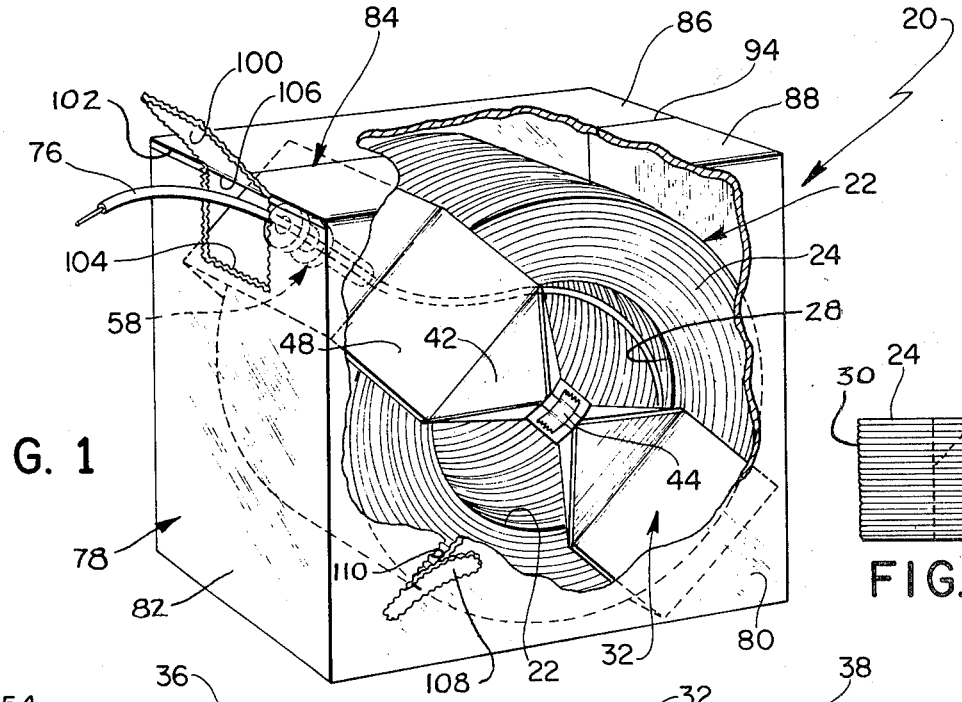
FIG. 1 is a perspective view, partially cut away and in section, illustrating the invention.
Figure 1A:
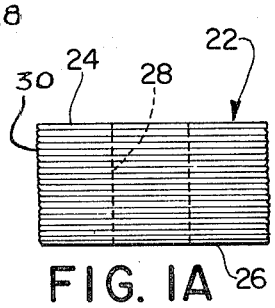
FIG. 1A is a side elevation view of a typical coil with which the invention is used.

Turning now to the drawings, and initially to FIG. 1, the invention is broadly illustrated and defined by the reference numeral 20 representing an assembly for packaging strand material in the form of a coil 22. The coil 22, which is more specifically seen in FIG. 1A, is preferably wound with a "universal wind". That is, the strand material on coil 22 forms two complete revolutions, or multiples thereof, for each traverse across the face of the coil. In this manner, strand material can be readily withdrawn from the coil without twist, at relatively high rates of payout.

With continued reference to FIG. 1A, the coil is defined as having a top 24 and a bottom 26 and an axial passage 28 extending from the top 24 to the bottom 26. A numeral 30 represents the projected thickness or face of the coil 22, which is to say the turned or traversed surface of the coil between its top 24 and its bottom 26.

Figure 2:
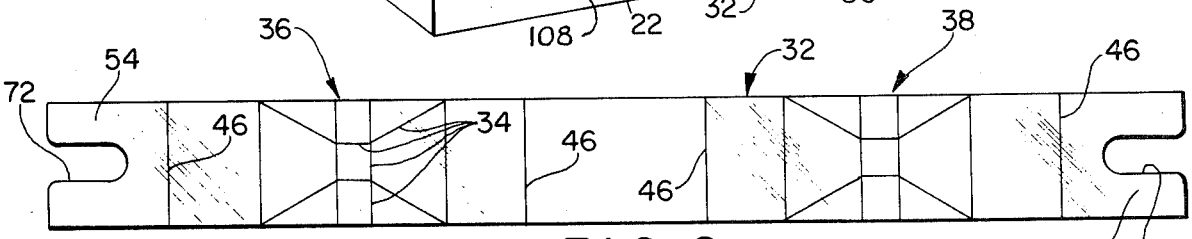
FIG. 2 is a top plan view of a dispensing strip which is one element of the invention, illustrating the dispensing strip in an initial stage of the sequence of steps in the construction of the invention.
Figure 3:
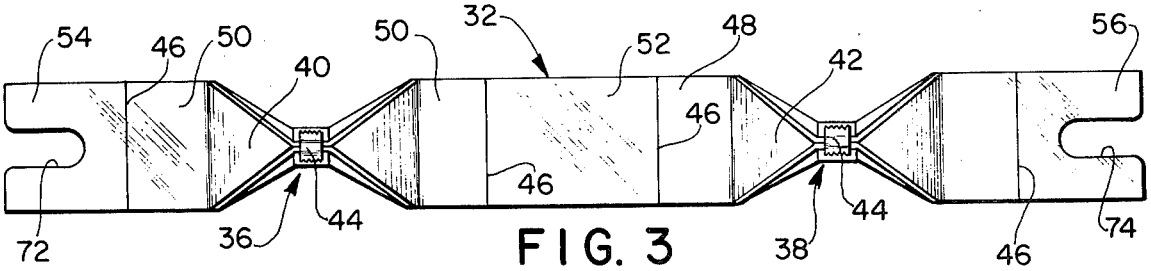
FIG. 3 is a top plan view of the dispensing strip illustrated in FIG. 2 but showing the strip in a later stage of the sequence of steps in the construction of the invention.

In accordance with the invention, an elongated strip is conformed to embrace the outer surface of the coil generally diametrically and across its projected thickness in a continuous loop, said strip including a pair of separated pyramid-shaped members intermediate its ends which projects into the axial passage of the coil, respectively, from opposite directions. As here embodied, with particular reference to FIGS. 2 and 3, an elongated strip 32, preferably formed of corrugated fiberboard or other stiff material, is suitably formed with creases or score lines 34 at a pair of separated locations as generally indicated by the reference numerals 36 and 38 in FIG. 2. When the strip 32 is folded at locations 36 and 38 in accordance with the teachings of the invention, a pair of pyramid-shaped members 40 and 42 (FIG. 3) is the result. Pressure sensitive tape 44 or staples 45 (FIG. 6) or other suitable binding means may be employed to assure that the pyramid-shaped members 40 and 42, respectively, maintain their shapes. Thus, as shown in FIG. 3, the strip 32 assumes a form such that at each of the locations 36 and 38 a pyramid form results in the thickness dimension and a narrow waist is formed in the width dimension.

Figure 4:
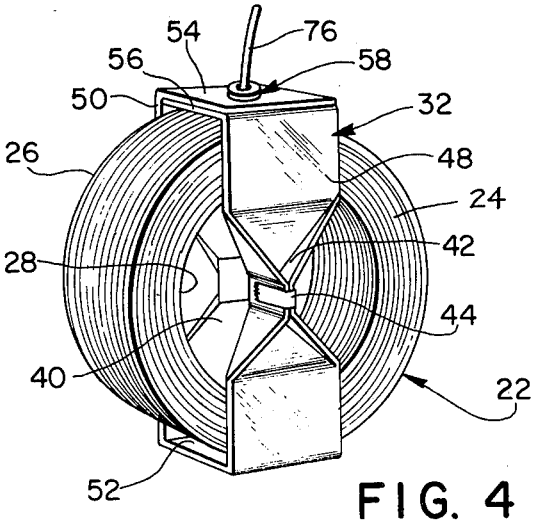
FIG. 4 is a perspective view of the dispensing strip as it is applied to a coil of strand material.

Other creases or lines 46 are provided in the elongated strip 32 at four different spaced locations enabling the strip to be folded into the form illustrated in FIG. 4. As seen in FIG. 4, the strip 32 is so conformed that first side portions 48 embrace the top 24 of the coil 22, and the pyramid-shaped member 42 located between the side portions extends into the axial passage 28 from adjacent the top of the coil. In a similar fashion, second side portions 50 of the strip 32 embrace the bottom 26 of the coil 22 and the pyramid 40 extends into the axial passage 28 from adjacent the bottom of the coil. The pyramid-shaped members 40 and 42 thus project into the axial passage 28, respectively, from opposite directions. A transverse side 52 of the strip 32 serves to embrace, tangentially, the projected thickness 30 of the coil 22. Ends 54 and 56, folded at their respective score lines 46, overlap and, similar to the transverse side 52, tangentially embrace the projected thickness 30 of the coil at a location diametrically opposite the transverse side 52.

Figure 5:
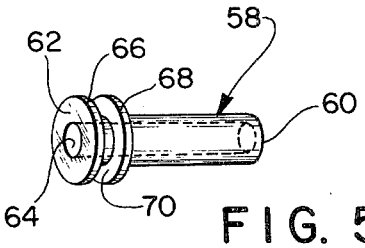
FIG. 5 is a perspective view of a feed tube which is another element of the invention.

In accordance with the invention, a hollow feed tube extends radially through the windings of the coil between an inner end at the axial passage and an outer end at the outer surface of the coil and positioned intermediate the top and bottom of the coil, said tube having a bore extending therethrough for receiving and guiding an end of the strand material from the passage as it is being unwound. As here embodied, with particular reference to FIGS. 5 and 6, a hollow feed tube 58 is shown having an inner end 60 and an outer end 62 and a bore 64 which extends the length of the tube 58 in FIG. 6. The feed tube 58 is illustrated as extending radially through the windings of the coil 22 between its inner end 60 at the axial passage 28 and its outer end 62 adjacent the outer surface or projected thickness 30 of the coil. Although the tube 58 is illustrated as being circular in cross-section, this is not critical to the invention, but it may assume any other desired cross-section, such as oval or polygonal, which achieves the same end result.

In accordance with the invention, said tube has an axis lying within a plane containing all elements of said strip, said tube including a pair of spaced flanges extending radially outwardly from the outer surface thereof adjacent the outer surface of the coil, and wherein said strip has slotted ends adapted for snug reception between said flanges thereby maintaining said strip in a contiguous relationship with the coil. As here embodied, with continuing reference to FIGS. 5 and 6, the tube 58 includes a pair of spaced flanges 66 and 68 which extend radially outwardly relative to the outer surface of the tube or relative to the longitudinal axis of the bore 64. In this manner, the flanges 66 and 68 define an annulus 70 between them. The ends 54 and 56 of the strip 32 (FIGS. 2 and 3) are respectively provided with slots 72 and 74 which engage the outer surface of the tube 58 within the annulus 70 when they are folded in a contiguous relationship as illustrated most clearly in FIGS. 4 and 6. The width of the annulus 70 is related to the sum of thicknesses of the ends 54 and 56 so that the ends are snugly received between the flanges 66 and 68. Thus, when the strip 32 conforms to the shape shown in FIGS. 4 and 6, it closely embraces the outer surface of the coil 22 and is maintained in a contiguous relationship with the coil, and lies within a plane which includes all elements of the strip including the flaps 54 and 56 and the pyramid-shaped members 40 and 42.

Figure 6:
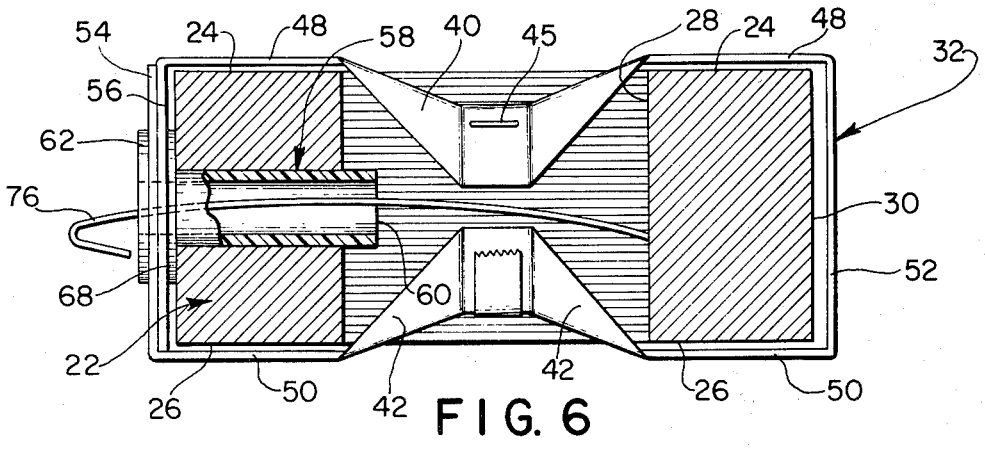
FIG. 6 is a side elevation view of FIG. 4, with portions being cut away and in section.

An end 76 of the strand material from coil 22 is shown in FIG. 6 withdrawn from the coil within the axial passage 28. As the end 76 is withdrawn from the coil, it is guided by the pyramid-shaped members 40 and 42 and through the feed tube 58. Adjacent its extremity, the end 76 of the strand material is shown preferably bent over so as to prevent it from retreating through the tube 58 into axial passage 28 while awaiting its further withdrawal from the coil 22.

In accordance with the invention, the assembly includes a regular slotted carton for supporting the coil and said strip and said tube therein, said carton having a pair of opposed major side walls, a pair of opposed minor side walls, and a pair of opposed end walls, the top and bottom of the coil being generally contiguous with a respective one of said major side walls. As embodied herein, with particular reference to FIG. 1, a regular slotted carton 78 is illustrated supporting the coil 22 and strip 32 and tube 58 within its confines. The carton 78 may be constructed in a conventional manner from a single sheet of material and folded so as to have a pair of opposed major side walls 80, a pair of opposed minor side walls 82, and a pair of opposed end walls 84. As shown, especially in FIG. 7, the top 24 of the coil 22 is contiguous with its associated major side wall 80 and, similarly, the bottom 26 of the coil is contiguous with the other major side wall 80 with which it is associated.

Figure 7:
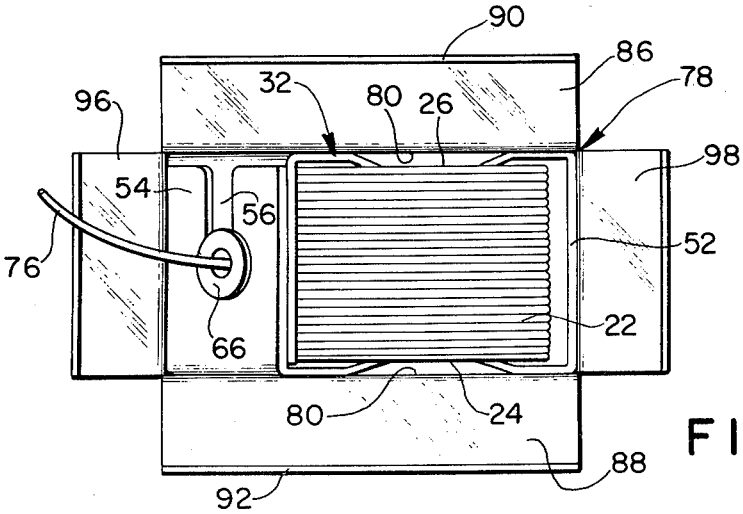
FIG. 7 is a top plan view of the carton and its contents illustrated in FIG. 1, with the closure flaps opened to reveal the interior of the carton.

The phrase "regular slotted carton" refers to a standard corrugated or solid fiberboard carton in which top and bottom outside sealing flaps meet in the center. In FIG. 1, then, each end wall 84 is seen to include a pair of sealing flaps 86 and 88 having respective edges 90 and 92 (FIG. 7) which meet along a center line 94 as shown in FIG. 1. With reference to FIG. 7, a pair of underlying flaps 96 and 98 are actually extensions of their respective minor side walls 82 and are folded down immediately prior to closure of the sealing flaps 86 and 88.

In accordance with the invention, one of said minor side walls has a flap associated with the outer end of said tube adjacent a corner of said carton defined by the intersection of said minor side walls with one of said end walls, said flap being defined by tearable perforations and including a hinge portion such that when said perforations are fully torn, said flap is movable about said hinge portion between a closed position and an open position to accommodate selective withdrawal of the strand material from the coil. As embodied herein, with particular reference to FIG. 1, one of the minor side walls 82 has a flap 100 associated with the outer end of the tube 58 which is adjacent a corner 102 of the carton 78 defined by the intersection of the minor side wall 82 with one of the end walls 84. The flap 100 is defined by perforations 104 and by a hinge portion 106 which permits the flap to pivot between a closed position and an open position as shown. It will be understood that before the assembly 20 is put into use, the flap 100 is in the closed position and sealed. Subsequently, when it is desired to withdraw the end 76 of the strand material from the coil 22, the perforations 104 are torn in a usual manner and the flap 100 pivoted to the open position about the hinge portion 106 as shown in FIG. 1.

In accordance with the invention, one of said major side walls includes a removable tab defining a slot extending from one corner of said carton to a location in the central regions of said one major side wall for viewing the amount of strand material remaining on the coil when said tab has been removed. As embodied herein, with particular reference to FIG. 1, the major side wall 80 includes a removable tab 108 which may be defined by perforations as with the flap 100. When the tab 108 has been selectively removed, it exposes a slot 110 which extends from a location proximate to one corner of the carton 78 to a location generally in the central regions of the major side wall 80. Of course, it will be appreciated that the orientation of the tab 108 and slot 110 within the major side wall 80 must be substantially perpendicular with the axis of the tube 58 so as not to coincide with the side portions 48 of the strip 32 when the strip is positioned in the carton 78. In this manner, a user of the assembly 20 can readily view the amount of strand material remaining on the coil 22 without in any manner disturbing the contents of the carton 78.

Figure 8:
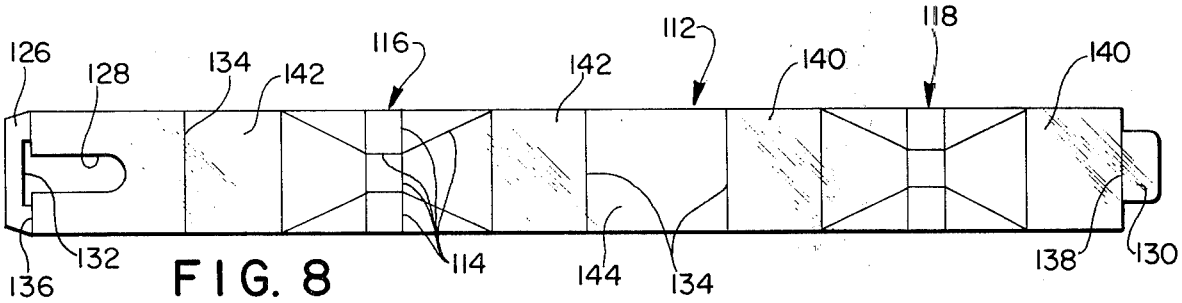
FIG. 8 is a top plan view, similar to FIG. 2, of another style of dispensing strip.

In accordance with the invention, one end of said strip is slotted for snug reception of said strip between said flaps and wherein the other end of said strip has a tab engageable with said slot thereby maintaining said strip in a contiguous relationship with the coil. As embodied herein, with particular reference to FIGS. 8 and 9, another embodiment of the strip 32 can be employed to embrace the outer surface of the coil 22. Thus, an elongated strip 112, preferably formed of corrugated fiberboard or other stiff material, is suitably formed with creases or score lines 114 at a pair of separated locations as generally indicated by the reference numerals 116 and 118 in FIG. 8. When the strip 112 is folded at locations 116 and 118 in accordance with the teachings of the invention, a pair of respective pyramid-shaped members 120 and 122 (FIG. 9) is the result. Pressure sensitive tape 124 or other suitable binding means may be employed to assure that the pyramid-shaped members 120 and 122, respectively, maintain their shapes.

Figure 9:
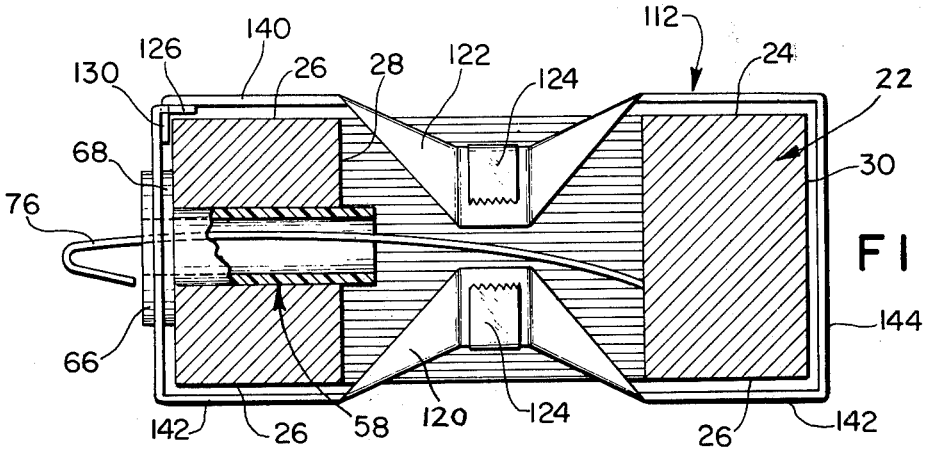
FIG. 9 is a side elevation view, similar to FIG. 6, illustrating a construction utilizing the dispensing strip of FIG. 8.

One end 126 of the strip 112 has a slot 128 formed therein and the opposite end of the strip has a tab 130 of a magnitude compatible with an extension 132 of the slot 128 to be engageably received therein (FIG. 9). Other creases or score lines 134 are provided on the elongated strip 112 at three different spaced locations enabling the strip to be folded into the form generally illustrated in FIG. 9. Additionally, a crease or score line 136 serves to define the one end 126 adjacent the extension slot 132 and a crease or score line 138 serves to define the tab 30 and enables the tab 130 and the end 126 to be mutually bent under and engaged in the manner illustrated in FIG. 9. Prior to insertion of the tab 130 into the extension slot 132, the outer flange 66 of the tube 58 is guided through the extension slot 132 to enable the tube to slide into the slot 128 thereby holding the strip 112 integral with the tube 58.

As seen in FIG. 9, the strip 112 is so conformed that first side portions 140 embrace the top 24 of the coil 22, and the pyramid-shaped member 122 located between the side portions 140 extends into the axial passage 28 from adjacent the top of the coil. In a similar fashion, the second side portions 142 of the strip 112 embrace the bottom 26 of the coil 22 and the pyramid-shaped member 120 extends into the axial passage 28 from adjacent the bottom of the coil. The pyramid-shaped members 120 and 122 thus project into the axial passage 28, respectively, from opposite directions. A transverse side 144 of the strip 112 serves to embrace, tangentially, the projected thickness 30 of the coil 22.

In accordance with the invention, a pair of elongated strips are conformed to mutually embrace the outer surface of the coil generally diametrically and across its projected thickness, each of said strips including side portions and opposed slotted ends and a pyramid-shaped member intermediate said side portions and said ends, one of said strips having its associated said side portions contiguous with the top of the coil and the other of said strips having its associated said side portions contiguous with the bottom of the coil, said ends of said ends of said strips being folded to overlie one another in a contiguous fashion across the projected thickness of the coil, at least one pair of said contiguous ends having a slot therein, said pyramid-shaped members projecting into the axial passage of the coil, respectively, from opposite directions. As embodied herein, with particular reference to FIGS. 10, 11, 12, and 13, a pair of elongated strips 146 are employed in still another embodiment of the invention. Each of the strips 146 includes a pair of side portions 148 and ends 150 with slots 152 suitably formed at the extremely of each end. Also, each of the strips is suitably formed with creases or score lines 154 at locations intermediate the ends 150. Additional creases or score lines 156 are suitably formed intermediate each side portion 148 and each end 150.

Figure 11:
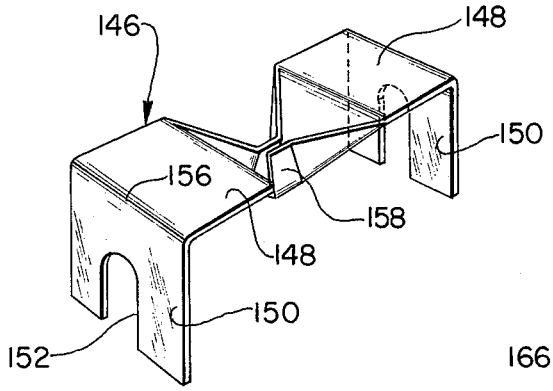
FIG. 11 is a perspective view of the dispensing strip illustrated in FIG. 10 but showing the strip in a later stage of the sequence of steps in the construction of the invention.
Figure 12:
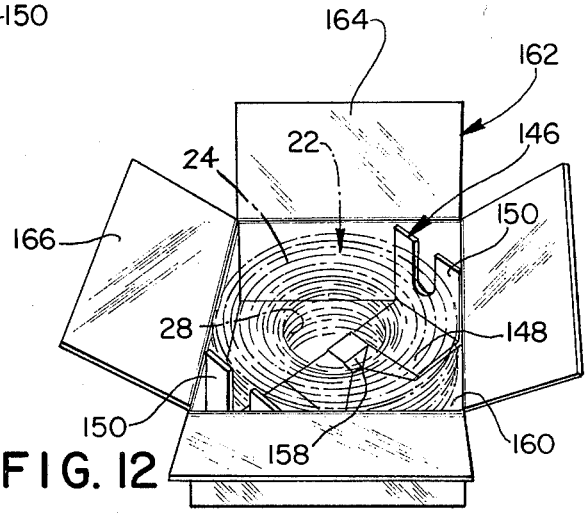
FIG. 12 is a perspective view of a carton utilizing the dispensing strip of FIGS. 10 and 11 with the closure flaps open to reveal its interior.
Figure 10:
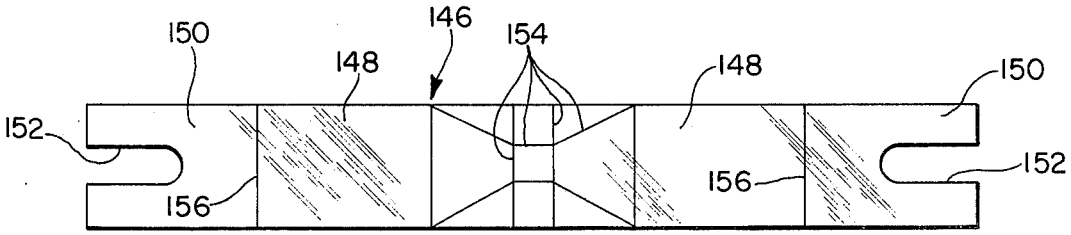
FIG. 10 is a top plan view, similar to FIGS. 2 and 7, of still another style of dispensing strip.

When the strip 146 is folded in accordance with the teachings of the invention, it assumes the shape indicated in FIG. 11 and includes a pyramid-shaped member 158 which results from folding along the score lines 154. As in the previous embodiments, pressure sensitive tape 159 (FIG. 13) or other suitable fastening means (not shown) may be used to enable the member 158 to maintain its shape. A matching strip 146 is illustrated in FIG. 12 as a mirror image of the strip illustrated in FIG. 11. Thus, in FIG. 12, the side portions 148 are shown resting on a major side wall 160 of a carton 162 with the pyramid-shaped member 158 shown extending upwardly.

The carton 162 differs slightly from carton 78 previously described with reference to FIGS. 1 and 7. The carton 78 (FIGS. 1 and 7) is so constructed that the coil 22 with its associated strip 32 is placed into the interior of the carton 78 when the sealing flaps 86 and 88 and the underlying flaps 96 and 98 of one end wall 84 are in the open position (FIG. 7). Thereupon, the underlying flaps 96 and 98, then the sealing flaps 86 and 88, are folded to the closed position as shown in FIG. 1. In contrast, with the construction shown in FIG. 12, the flaps 164 and 166 form the major side wall 160 of the carton 162. When these flaps are opened, the carton 162 permits entry of the coil 22 into its interior. When the coil 22 has been placed in the carton 162, the flaps 164 and 166 are sealed in any customary manner.

With continued reference to FIG. 12, the coil 22 is illustrated by means of phantom lines such that the bottom of the coil rests on and is contiguous with the side portions 148 of the strip 146 which in turn rests on and is contiguous with the major side wall 160 of the carton. Additionally, the pyramid-shaped member 158 extends upwardly into the axial passage 28 of the coil 22. With the coil 22 in place within the carton 162, the other of the pair of strips 146 is placed over the coil so that the side portions 148 are contiguous with the top 24 of the coil and the ends 150 of the pair of strips thus overlie one another in a contiguous fashion across the projected thickness of the coil 22. The pyramid-shaped member 158 of the upper strip 146 thus extends downwardly into the axial passsage 28 from adjacent the top 24 of the coil. Flaps 164 and 166 of the carton 162 may then be closed and sealed. The carton 162 is preferably provided with the auxiliary features illustrated in FIG. 1 with respect to the carton 78 as previously described.

Figure 13:
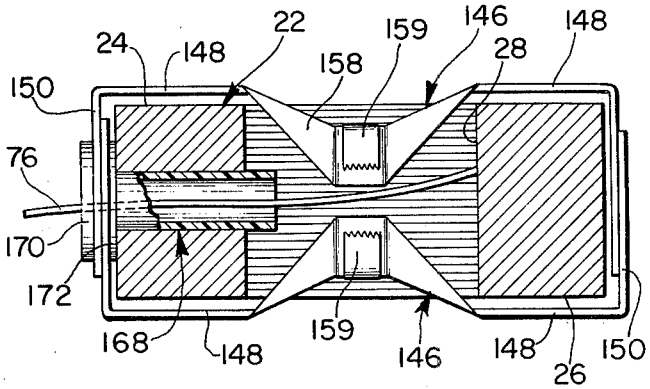
FIG. 13 is a side elevation view, similar to FIGS. 6 and 8, illustrating the assembly utilizing the dispensing strip of FIGS. 10 and 11.

Viewing FIG. 13, a feed tube 168 is in all respects similar to the feed tube 58 previously described and extends radially through the windings of the coil 22. At its outer end, the feed tube 168 includes a pair of spaced flanges 170 and 172 which define between them an annulus for the reception therein of the slots 152 in each of the strips 146. In this manner, the strips 146 are thereby maintained in a contiguous relationship with the coil 22 and the tube, as previously described, is enabled to receive and guide the end 76 of the strand material from the passage 28 as it is being unwound.

Figure 14:
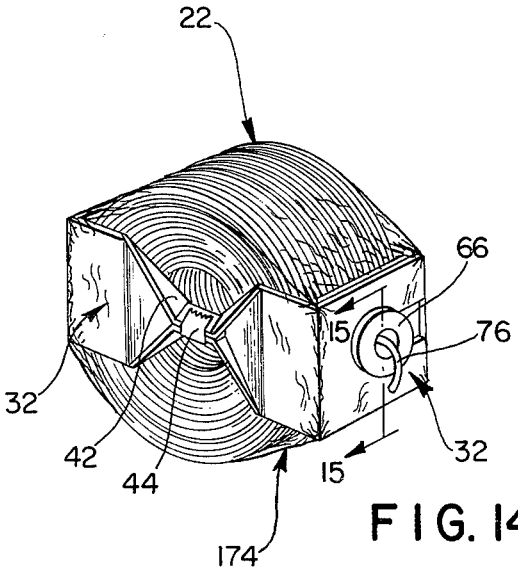
FIG. 14 is a perspective view illustrating another embodiment of the invention.
Figure 15:
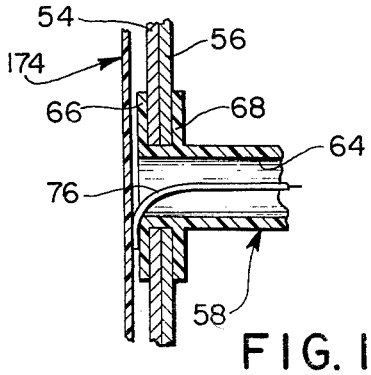
FIG. 15 is a detail cross-section view taken along line 15—15 in FIG. 14.

In accordance with the invention, a container is provided for supporting and enclosing the coil and said strip and said tube therein composed of flexible heat shrinkable sheet material snugly enveloping the coil and said strip and said tube. As embodied herein, with particular reference to FIGS. 14 and 15, a container 174 is composed of a plastic material, for example, vinyl or polyethylene. The container 174 surrounds a combination of the coil 22 and the dispenser strip 32 and the tube 58 and is heat shrinkable so as to closely conform to the outer contours of the combination. Although only one such combination is illustrated in FIG. 14, it will be understood that any number of such combination can be so packaged. Whenever desired, the container 174 can be suitably pierced for selective withdrawal of the end 76 of the strand material from the coil 22. In all other features, the combination may be of any of the constructions previously described. Hence, any combination could assume the form as illustrated in FIG. 6, FIG. 9, or FIG. 13. By reason of this construction, one or more coils 22 and their associated strips and tubes are held together and simultaneously are provided with waterproof protection. Such a construction also permits, for example, the provision of a variety of colored wire from a single package. In still another embodiment, a number of such combinations individually wrapped within a container 174 may be supported in a larger container (not shown) formed or corrugated fiberboard or other suitable stiff material.

The invention, in its broader aspects is not limited to the specific details shown and described, and departures may be made from such details without departing from the principles of the invention, and without sacrificing its chief advantages.

What is claimed is:

1. An assembly for packaging strand material in the form of a coil having a top and a bottom and an axial passage extending therethrough between the top and the bottom comprising:

an elongated strip conformed to embrace the outer surface of the coil generally diametrically and across its projected thickness in a continuous loop, said strip including a pair of separated pyramid-shaped members intermediate its ends which project into the axial passage of the coil, respectively, from opposite directions; and a hollow feed tube extending radially through the windings of the coil between an inner end at the axial passage and an outer end at the outer surface of the coil and positioned intermediate the top and the bottom of the coil, said tube having a bore extending therethrough for receiving and guiding an end of the strand material from the passage as it is being unwound.

2. An assembly as set forth in claim 1 wherein said tube has an axis lying within a plane containing all elements of said strip, said tube including a pair of spaced flanges extending radially outwardly from the outer surface thereof adjacent the outer surface of the coil, and wherein said strip has slotted ends adapted for snug reception between said flanges thereby maintaining said strip in a contiguous relationship with the coil.

3. An assembly as set forth in claim 1 wherein said tube has an axis lying within a plane containing all elements of said strip, said tube including a pair of spaced flanges extending radially outwardly from the outer surface thereof ajdacent the outer surface of the coil, and wherein one end of said strip is slotted for snug reception of said strip between said flanges and wherein the other end of said strip has a tab engageable with said slot to thereby maintain said strip in a contiguous relationship with the coil.

4. An assembly as set forth in claim 1 including a container for supporting and enclosing the coil and said strip and said tube therein and having a flap hinged for selective movement between open and closed positions and positioned in association with said tube for withdrawal of the strand material from the coil when said flap is in the open position.

5. An assembly as set forth in claim 1 including a container for supporting and enclosing the coil and said strip and said tube therein and having means for viewing the amount of strand material remaining on the coil.

6. The assembly as set forth in claim 1 including a regular slotted carton for supporting the coil and said strip and said tube therein, said carton having a pair of opposed major side walls, a pair of opposed minor side walls, and a pair of opposed end walls, the top and bottom of the coil being generally contiguous with a respective one of said major side walls, one of said minor side walls having a flap associated with the outer end of said tube adjacent a corner of said carton defined by the intersection of said minor side wall with one of said end walls, said flap being defined by tearable perforations and including a hinge portion such that when said perforations are fully torn, said flap is movable about said hinge portion between a closed position and an open position to accommodate selective withdrawal of the strand material from the coil.

7. An assembly as set forth in claim 6 wherein one of said major side walls includes a removable tab defining a slot extending from one corner of said carton to a location in the central regions of said one major side wall for viewing the amount of strand material remaining on the coil when said tab has been removed.

8. An assembly for packaging strand material in the form of a coil having a top and a bottom and an axial passage extending therethrough between the top and the bottom comprising:

at least one elongated strip conformed to embrace the outer surface of the coil generally diametrically and across its projected surface in a continuous loop, said strip having a pair of slotted ends and a pair of separated pyramid-shaped members intermediate said ends which project into the axial passage of the coil respectively, from opposite directions;

a hollow feed tube extending radially through the windings of the coil between an inner end at the axial passage, and an outer end at the outer surface of the coil and positioned intermediate the top and the bottom of the coil, said tube lying within a plane containing all elements of said strip and including a pair of spaced flanges extending radially outwardly from the outer surface thereof adjacent the outer surface of the coil, said flanges defining an annulus therebetween adapted for the snug reception therewithin of said slotted ends thereby maintaining said strip in a contiguous relationship with the coil, said tube further having a bore extending therethrough for receiving and guiding an end of the strand material from the passage as it is being unwound; and A regular slotted carton for supporting the coil and said strip therein, said carton having a pair of opposed major side walls, a pair of opposed minor side walls, and a pair of opposed end walls, the top and bottom of the coil being generally contiguous with a respective one of said major side walls, one of said minor side walls having a flap associated with the outer end of said tube adjacent a corner of said carton defined by the intersection of said minor side wall with one of said end walls, said flap being defined by tearable perforations and including a hinge portion such that when said perforations are fully torn, said flap is movable about said hinge portion between a closed position and an open position to accommodate selective withdrawal of the strand material from the coil, said major side walls including a removable tab defining a slot extending from one corner of said carton to a location in the central regions of said one major side wall for viewing the amount of strand material remaining on the coil when said tab has been removed.

9. An assembly for packaging strand material in the form of a coil having a top and a bottom and an axial passage extending therethrough between the top and the bottom comprising:

at least one elongated strip conformed to embrace the outer surface of the coil generally diametrically and across its projected surface in a continuous loop, said strip having one end with a slot therein and another end having a tab compatible for reception within the slot to thereby maintain said strip in a contiguous relationship with the coil, and a pair of separated pyramid-shaped members intermediate said ends which project into the axial passage of the coil, respectively, from opposite directions;

a hollow feed tube extending radially through the windings of the coil between an inner end at the axial passage, and an outer end at the outer surface of the coil and positioned intermediate its top and the bottom of the coil, said tube lying within a plane containing all elements of said strip and including a pair of spaced flanges extending radially outwardly from the outer surface thereof adjacent the outer surface of the coil, said flanges defining an annulus therebetween adapted for the snug reception therewithin of said slotted end thereby cooperating with said tab and the slot to maintain said strip in a contiguous relationship with the coil, said tube further having a bore extending therethrough for receiving and guiding an end of the strand material from the passage as it is being unwound; and a regular slotted carton for supporting the coil and said strip therein, said carton having a pair of opposed major side walls, a pair of opposed minor side walls, and a pair of opposed end walls, the top and bottom of the coil being generally contiguous with a respective one of said major side walls, one of said minor side walls having a flap associated with the outer end of said tube adjacent a corner of said carton defined by the intersection of said minor side wall with one of said end walls, said flap being defined by tearable perforations and including a hinge portion such that when said perforations are fully torn, said flap is movable about said hinge portion between a closed position and an open position to accomodate selective withdrawal of the strand material from the coil, said major side walls including a removable tab defining a slot extending from one corner of said carton to a location in the central regions of said one major side wall for viewing the amount of strand material remaining on the coil when said tab has been removed.

10. An assembly for packaging strand material in the form of a coil having a top and a bottom and an axial passage extending therethrough between the top and bottom comprising:

a pair of elongated strips conformed to mutually embrace the outer surface of the coil generally diameterically and across its projected thickness, each of said strips including side portions and opposed slotted ends and a pyramid-shaped member intermediate said side portions and said ends, one of said strips having its associated said side portions contiguous with the top of the coil and the other of said strips having its associated said side portions contiguous with the bottom of the coil, said ends of said strips being folded to overlie one another in a contiguous fashion across the projected thickness of the coil, at least one pair of said contiguous ends having a slot therein, said pyramid-shaped members projecting into the axial passage of the coil, respectively, from opposite directions; and a hollow feed tube extending radially through the windings of the coil between an inner end at the axial passage and an outer end at the outer surface of the coil and positioned intermediate the top and the bottom of the coil, said tube including a pair of spaced flanges extending radially outwardly from the outer surface thereof adjacent the outer surface of the coil, said flanges defining an annulus therebetween adapted for the snug reception therewithin of said contiguous ends thereby maintaining said strips in a contiguous relationship with the coil, and said tube having a bore extending therethrough for receiving and guiding an end of the strand material from the passage as it is being unwound.

11. An assembly as set forth in claim 10 including a container for supporting and enclosing the coil and said strip and said tube therein and having a flap hinged for selective movement between open and closed positions and arranged in association with said tube for withdrawal of the strand material from the coil when said flap is in the open position.

12. An assembly as set forth in claim 10 including a container for supporting and enclosing the coil and said strip and said tube therein and having means for viewing the amount of strand material remaining on the coil.

13. The assembly as set forth in claim 10 including a regular slotted carton for supporting the coil and said strip and said tube therein, said carton having a pair of opposed major side walls, a pair of opposed minor side walls, and a pair of opposed end walls, the top and bottom of the coil being generally contiguous with a respective one of said major side walls, one of said minor side walls having a flap associated with the outer end of side tube adjacent a corner of said carton defined by the intersection of said minor side wall with one of said end walls, said flap being defined by tearable perforations and including a hinge portion such that when said perforations are fully torn, said flap is movable about said hinge between a closed position and an open position to accommodate selective withdrawal of the strand material from the coil.

14. The assembly as set forth in claim 12 including a regular slotted carton for supporting the coil and said strip and said tube therein, said carton having a pair of opposed major side walls, a pair of opposed minor side walls, and a pair of opposed end walls, the top and bottom of the coil being generally contiguous with a respective one of said major side walls, one of said minor side walls having a flap associated with the outer end of said tube adjacent a corner of said carton defined by the intersection of said minor side wall with one of said end walls, said flap being defined by tearable perforations and including a hinge portion such that when said perforations are fully torn, said flap is movable about said hinge portion between a closed position and an open position to accommodate selective withdrawal of the strand material from the coil.

15. The assembly as set forth in claim 1 including a container for supporting and enclosing the coil and said strip and said tube therein composed of flexible heat shrinkable plastic sheet material snugly enveloping the coil and said strip and said tube.

* * * * *